US010246833B2

(12) United States Patent
Blank et al.

(10) Patent No.: US 10,246,833 B2
(45) Date of Patent: Apr. 2, 2019

(54) ASPHALT PAVING MACHINE OPERATIONAL REPORTING SYSTEM

(71) Applicant: Roadtec, Inc., Chattanooga, TN (US)

(72) Inventors: Mikel A. Blank, Ooltewah, TN (US); David Swearingen, Ooltewah, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 15/899,492

(22) Filed: Feb. 20, 2018

(65) Prior Publication Data

US 2018/0238000 A1 Aug. 23, 2018

Related U.S. Application Data

(60) Provisional application No. 62/462,618, filed on Feb. 23, 2017.

(51) Int. Cl.
*E01C 19/00* (2006.01)
*E01C 19/20* (2006.01)
*E01C 19/48* (2006.01)

(52) U.S. Cl.
CPC ..... *E01C 19/202* (2013.01); *E01C 19/48* (2013.01); *E01C 2019/207* (2013.01); *E01C 2019/2065* (2013.01)

(58) Field of Classification Search
CPC ..... E01C 19/202; E01C 2019/207; E01C 2019/2065; E01C 19/48
USPC ..... 404/84.05, 118
See application file for complete search history.

(56) References Cited

U.S. PATENT DOCUMENTS 5,277,710 A * 1/1994 Aho ..... C08L 95/00 106/273.1
5,356,238 A * 10/1994 Musil ..... E01C 19/008 404/101
5,452,966 A * 9/1995 Swisher, Jr. ..... E01C 19/48 404/108
6,517,281 B1 * 2/2003 Rissi ..... E01C 19/203 239/659
8,282,312 B2 10/2012 Braddy et al.
8,469,630 B2 * 6/2013 Olson ..... E01C 19/48 404/84.05
8,696,236 B1 * 4/2014 Frelich ..... E01C 19/48 244/99.4
8,930,092 B2 1/2015 Minich
8,979,423 B2 3/2015 Smieja
(Continued)

*Primary Examiner* — Raymond W Addie
(74) *Attorney, Agent, or Firm* — Chambliss, Bahner & Stophel, P.C.

(57) ABSTRACT

An asphalt paving machine includes a drive system, an asphalt receiving hopper and a distributing auger. A hopper conveyor, which is adapted to transport asphalt paving material from the receiving hopper to the distributing auger, includes a hopper conveyor motor and a speed sensor. A vertically-adjustable flow gate defines the size of the gate opening from the asphalt receiving hopper to the distributing auger, and a flow gate position sensor is adapted to determine the vertical position of the flow gate. A controller includes a timer and is operatively connected to the drive system for the paving machine, the speed sensor for the hopper conveyor motor and the flow gate position sensor. The controller uses a machine speed signal, a conveyor speed signal and a flow gate signal to measure the amount of asphalt paving material delivered to the distributing auger per unit of time.

10 Claims, 6 Drawing Sheets

(56) References Cited

U.S. PATENT DOCUMENTS

| | | | | |
|---|---|---|---|---|
| 9,011,038 | B2 * | 4/2015 | Buschmann | E01C 19/00 404/101 |
| 9,347,186 | B2 * | 5/2016 | Frelich | E01C 19/48 |
| 2002/0182009 | A1 * | 12/2002 | Barnat | E01C 19/21 404/111 |
| 2008/0300758 | A1 * | 12/2008 | Young | B62D 11/003 701/50 |
| 2009/0097918 | A1 * | 4/2009 | Larson | E01C 19/21 404/75 |
| 2010/0101785 | A1 * | 4/2010 | Khvoshchev | E21B 34/16 166/250.01 |
| 2012/0288328 | A1 * | 11/2012 | Minich | E01C 23/07 404/72 |
| 2013/0195550 | A1 * | 8/2013 | Bertz | E01C 19/48 404/72 |
| 2014/0186115 | A1 * | 7/2014 | Graham | E01C 19/4873 404/75 |
| 2016/0281311 | A1 * | 9/2016 | Jacconna | E01H 10/007 |
| 2017/0228108 | A1 * | 8/2017 | Marsolek | G06F 3/0482 |

* cited by examiner

ASPHALT PAVING MACHINE OPERATIONAL REPORTING SYSTEM

CROSS-REFERENCE TO RELATED APPLICATION

This application claims the benefit of U.S. Provisional Patent Application No. 62/462,618 which was filed on Feb. 23, 2017.

FIELD OF THE INVENTION

The present invention relates generally to asphalt paving machines, and more particularly, to a method and apparatus for measuring and recording the operating rate of an asphalt paving machine.

BACKGROUND OF THE INVENTION

Paving of a roadway with asphalt paving material is generally carried out by a paving machine that is supplied with asphalt paving material by a number of supply trucks and/or a material transfer vehicle. The paving machine is self-propelled and driven by a wheeled or tracked drive system. In a common type of paving machine, an asphalt receiving hopper is located at the front end of the machine to receive asphalt paving material from a truck or material transfer vehicle, and a hopper conveyor located below and/or behind the asphalt receiving hopper transfers the asphalt paving material from the hopper to a transverse distributing auger that is mounted near the rear of the machine. The asphalt paving material is deposited onto and across the roadway or other surface to be paved by the distributing auger. A floating screed located at the rear end of the machine behind the distributing auger compacts the asphalt paving material to form an asphalt mat.

Asphalt paving material is comprised of an asphaltic binder and aggregates of various particle sizes, including both coarse and fine aggregate materials. Because the equipment needed to produce asphalt paving material is expensive and the space required extensive, asphalt paving material is typically produced in a production facility that is dedicated to such purpose. Consequently, it is frequently necessary to transport the asphalt paving material from its place of origin to an asphalt paving machine at a remote paving site. The asphalt paving material is transported in dump trucks to an asphalt paving machine or to a material transfer vehicle that completes the transfer to the asphalt paving machine. Sometimes, asphalt paving material is discharged directly from the transport dump trucks into the asphalt receiving hopper of the asphalt paving machine. On other occasions, however, material transfer vehicles are used to shuttle asphalt paving material between the supply trucks and the asphalt paving machine.

A self-propelled material transfer vehicle typically includes a large-capacity truck-receiving hopper and an inclined truck-unloading conveyor extending upwardly from this hopper. Asphalt paving material carried by the truck-unloading conveyor from the truck-receiving hopper is discharged off the elevated output end of the truck-unloading conveyor into a chute mounted on the lower end of a paver-loading conveyor, or into an intermediate surge bin that is sized to hold the entire load of a delivery truck. The discharge of asphalt paving material off the elevated output end of the truck-unloading conveyor so that it may fall under the influence of gravity into a chute or surge bin assists in preventing undesirable segregation of the various particulate components of the asphalt paving material by particle size. Material transfer vehicles of the type that are equipped with a surge bin typically include a conveyor in the surge bin that is adapted to transfer the asphalt paving material to a paver-loading conveyor. Paver-loading conveyors mounted on material transfer vehicles with and without surge bins are generally pivotable about an essentially vertical axis so that the transfer vehicle can be positioned alongside an asphalt paving machine that is laying an asphalt mat and rapidly discharge asphalt paving material into the hopper of the paving machine as the material transfer vehicle moves with the paving machine along the roadway. Because of its rapid loading and unloading capabilities, a material transfer vehicle can rapidly shuttle between delivery trucks at a pick-up point and an asphalt paving machine that is laying an asphalt mat at a paving site so that there is less likelihood that the paving machine will have to stop paving because of a lack of asphalt paving material.

Regardless of how the asphalt paving material is delivered to the asphalt paving machine, the rate of delivery of asphalt paving material to the paving machine may vary during a paving operation, depending on the production rate at the asphalt production facility, the demand for asphalt paving material produced by such facility, traffic conditions encountered by the delivery vehicles and conditions at the paving site, among other variables. Consequently, it is sometimes necessary for the asphalt paving machine to wait on the delivery of asphalt paving materials. Starting and stopping an asphalt paving machine during a paving operation can cause variations in the surface of the roadway being paved. Therefore, it generally advantageous to control the paving operation to insure a consistent flow of asphalt paving material through the paving machine as the paving process is carried out. A paving machine operator may focus on controlling the rate of advance of the asphalt paving machine across the roadway and on steering the machine during the paving operation. However, it would also be desirable if a method and system could be provided that could control the rate of deposition of asphalt paving material on the roadway by the distributing auger.

Advantages of a Preferred Embodiment of the Invention

Among the advantages of a preferred embodiment of the invention is that it provides a method and apparatus for controlling the rate of flow of asphalt paving material through an asphalt paving machine. Another advantage of a preferred embodiment of the invention is that it provides a method and apparatus for controlling the paving operation to insure a consistent flow of asphalt paving material through the asphalt paving machine as the paving process is carried out. Still other advantages and features of this invention will become apparent from an examination of the drawings and the ensuing description.

Notes on Construction

The use of the terms “a”, “an”, “the” and similar terms in the context of describing the invention are to be construed to cover both the singular and the plural, unless otherwise indicated herein or clearly contradicted by context. The terms “comprising”, “having”, “including” and “containing” are to be construed as open-ended terms (i.e., meaning “including, but not limited to,”) unless otherwise noted. The terms “substantially”, “generally” and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "coupled", "connected" and "interconnected", refer to a relationship wherein structures are secured or attached to one another either directly or indirectly through intervening structures, as well as both moveable and rigid attachments or relationships, unless specified herein or clearly indicated by context. The terms "operatively connected" and "operatively attached" describe such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "linear actuator" refers to an electric, pneumatic, hydraulic, electro-hydraulic or mechanical device that generates force which is directed in a straight line. Common examples of "linear actuators" are hydraulic and pneumatic actuators which include a cylinder, a piston within the cylinder, and a rod attached to the piston. By increasing the pressure within the cylinder on one side of the piston (over that on the opposite side of the piston), the rod will extend from the cylinder or retract into the cylinder.

The term "asphalt paving material(s)" refers to a bituminous paving mixture that is comprised of an asphaltic binder and aggregate materials of various types and particle sizes, including both coarse and fine aggregate materials.

The terms "asphalt paving machine", "paving machine" and similar terms refer to a finishing machine for applying asphalt paving material to form an asphalt mat on a roadway, parking lot or similar surface.

The term "paving direction", when used in describing the operation of an asphalt paving machine or the relative position of an asphalt paving machine or a component of a paving machine, refers to the direction of advance of the asphalt paving machine as the paving operation is carried out.

The term "hopper conveyor" refers to a conveyor which is adapted to transport asphalt paving material from the asphalt receiving hopper of a paving machine to the distributing auger of the paving machine.

The terms "front" and "front end" of the asphalt paving machine refer to the end of the machine that leads in the paving direction. When referring to a component of the paving machine, the terms "front" and "front end" refer to that portion of the component that is nearer the front end of the asphalt paving machine.

The terms "rear" and "rear end" of the asphalt paving machine refer to the end of the paving machine opposite the front end. When referring to a component of the paving machine, the terms "rear" and "rear end" refer to that portion of the component that is nearer the rear end of the paving machine.

The terms "forward" and "in front of", as used herein to describe a relative position or direction on or in connection with an asphalt paving machine or a component of the paving machine, refer to a relative position towards the front end of the machine.

The terms "rearward", "behind" and "rearwardly", as used herein to describe a relative position or direction on or in connection with an asphalt paving machine or a component of the paving machine, refer to a relative position or direction towards the rear end of the machine.

The terms "downward" and "downwardly", as used herein to describe a relative direction on or in connection with an asphalt paving machine or a flow gate associated with a hopper conveyor of an asphalt paving machine, refer to a direction towards the roadway that is being paved by the paving machine.

The terms "lower" and "below", as used herein to describe the relative position of a flow gate, or a portion or component thereof, in an asphalt paving machine, refer to a relative position that is in the downward direction.

The terms "upward" and "upwardly", as used herein to describe a relative direction on or in connection with a paving machine or a flow gate associated with a hopper conveyor of an asphalt paving machine, refer to a direction away from the roadway that is being paved by the paving machine.

The terms "upper" and "above", as used herein to describe the relative position of a flow gate, or a portion or component thereof, in an asphalt paving machine, refer to a relative position that is in the upward direction.

The term "right", when used herein to describe a relative position or direction on or in connection with an asphalt paving machine, or a component thereof, refers to the right side of the machine or component from the perspective of an operator who is driving the paving machine in the paving direction.

The term "left", when used herein to describe a relative position or direction on or in connection with an asphalt paving machine or a component thereof, refers to the left side of the machine or component from the perspective of an operator who is driving the paving machine in the paving direction.

SUMMARY OF THE INVENTION

The invention comprises an asphalt paving machine having a drive system for moving the paving machine across the surface to be paved. The paving machine also includes an asphalt receiving hopper, a distributing auger and a hopper conveyor that is powered by a hopper conveyor motor and is adapted to convey asphalt paving material from the receiving hopper to the distributing auger. The invention comprises a moveable flow gate associated with the hopper conveyor, which flow gate is moveable between various positions that restrict to a greater or lesser extent the passage of asphalt paving material from the hopper of the asphalt paving machine to the distributing auger. Sensors generate signals indicative of the speed of the hopper conveyor (or the hopper conveyor motor) and the position of the flow gate and transmit these signals to a controller. The controller includes a timer and is also operatively connected to the drive system for moving the paving machine. The controller uses the machine speed signal, the conveyor speed signal and the flow gate signal to measure the amount of asphalt paving material delivered to the distributing auger per unit of time.

In another embodiment of the invention, the controller is adapted to receive a coefficient of efficiency for the hopper conveyor and to use this coefficient of efficiency in measuring the amount of asphalt paving material delivered to the distributing auger per unit of time. Still another embodiment of the invention comprises a flow gate that is associated with the hopper conveyor and adapted to define the size of the gate opening from the asphalt receiving hopper to the distributing auger. This flow gate further comprises a linear actuator for moving the flow gate substantially vertically to any of various positions between an upper position that maximizes the size of the gate opening from the asphalt receiving hopper and a lower position that minimizes the gate opening from the asphalt receiving hopper. A flow gate position sensor is adapted to determine the vertical position of the flow gate, and the controller is operatively connected to the linear actuator for moving the flow gate, and to the flow gate position sensor, and is adapted to move the flow gate to a vertical position that is selected by an operator of the paving machine.

Another embodiment of the invention includes a material sensor that is attached to the flow gate. This material sensor is operatively connected to the controller and adapted to signal to the controller if asphalt paving material is passing under the flow gate. In this embodiment of the invention, the material sensor has an arm that extends below the bottom of the flow gate. This arm is adapted to pivot upwardly when asphalt paving material is struck off by the flow gate. The material sensor also has a switch that is configured to be actuated when the arm of the material sensor pivots upwardly in order to signal the controller that asphalt paving material is passing under the flow gate.

In a preferred embodiment of the invention, the controller is operatively connected to an onboard viewing screen which is adapted to display to an operator the amount of asphalt paving material delivered to the distributing auger per unit of time. In yet another embodiment of the invention, the controller is operatively connected to a wireless transmitter which is adapted to transmit to an external receiver the amount of asphalt paving material delivered to the distributing auger per unit of time.

In other embodiments of the invention, the controller is adapted to measure the time during which asphalt paving material is delivered to the distributing auger, and to calculate the distance traveled by the paving machine while asphalt paving material is being delivered to the distributing auger.

In other embodiments of the invention, the controller is adapted to measure the accumulated time during which asphalt paving material is delivered to the distributing auger, and receive a "start" input signal from an operator that is associated with the beginning of use of a wear item such as a conveyor chain or a screed plate. In this embodiment of the invention, the controller is adapted to measure the total tonnage of asphalt paving material delivered to the distributing auger during the period of use of a selected wear item.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter described herein, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
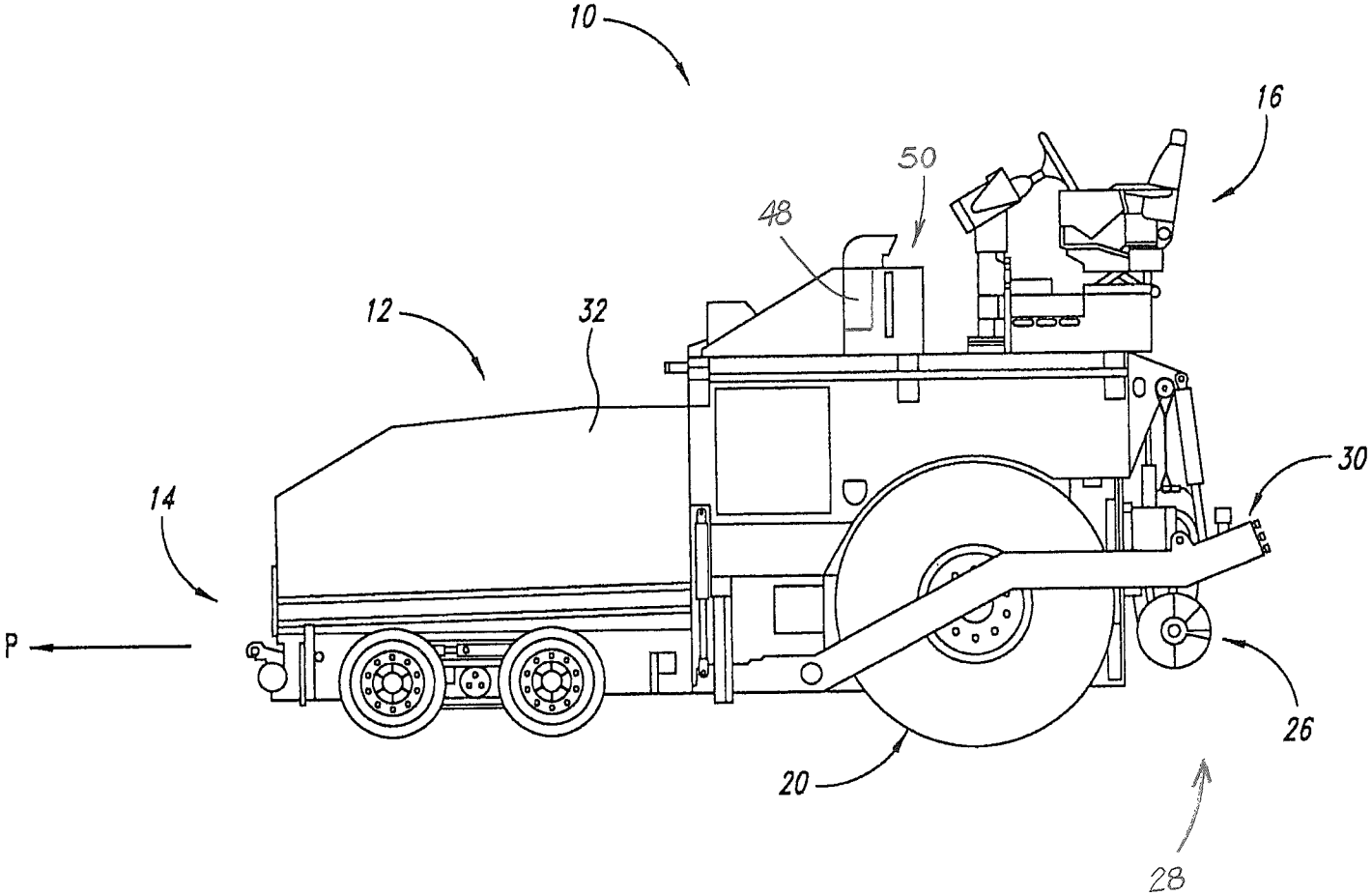
FIG. 1 is a side view of an asphalt paving machine which includes the invention.
Figure 2:
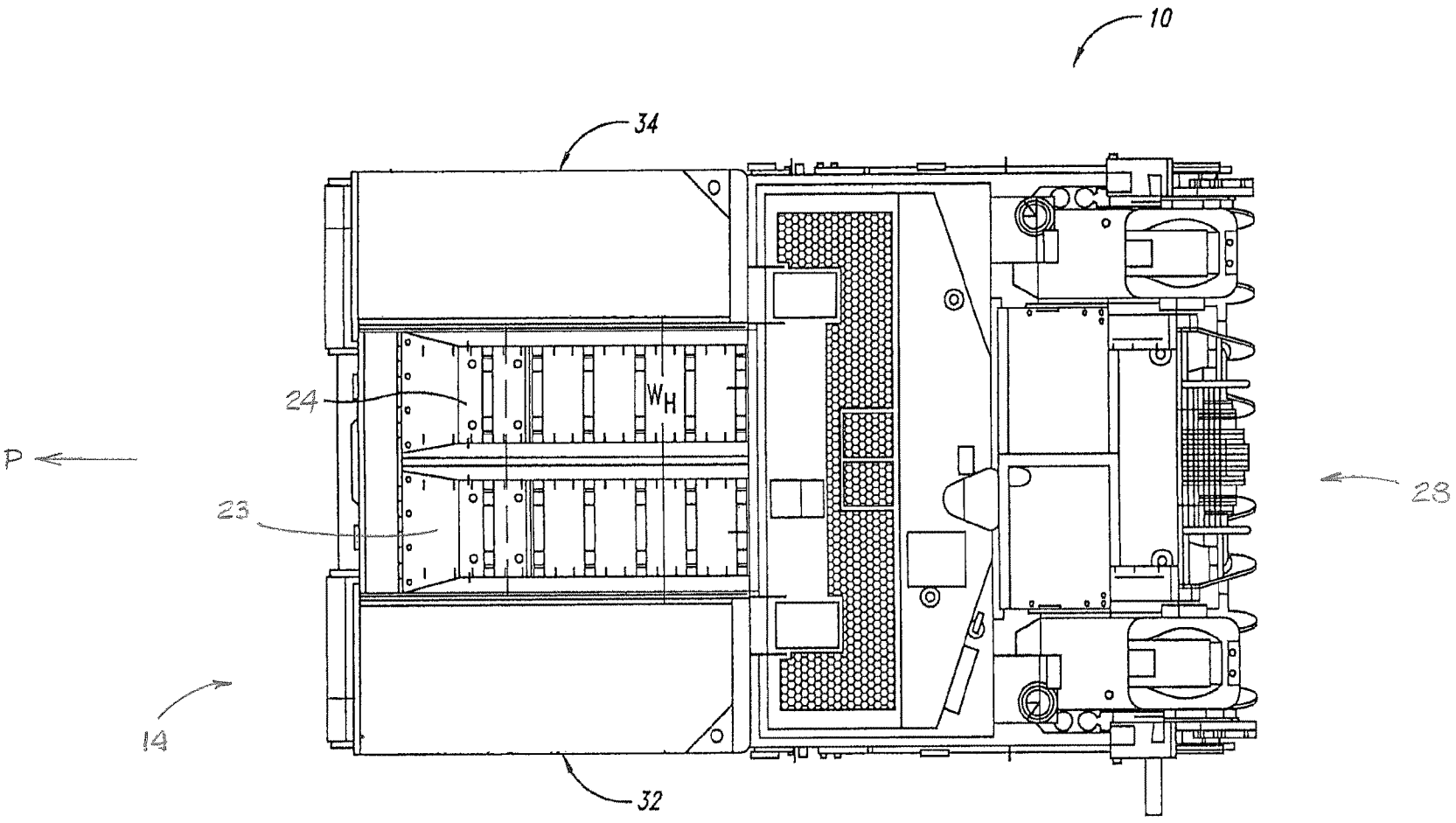
FIG. 2 is a top view of the asphalt paving machine shown in FIG. 1.
Figure 3:
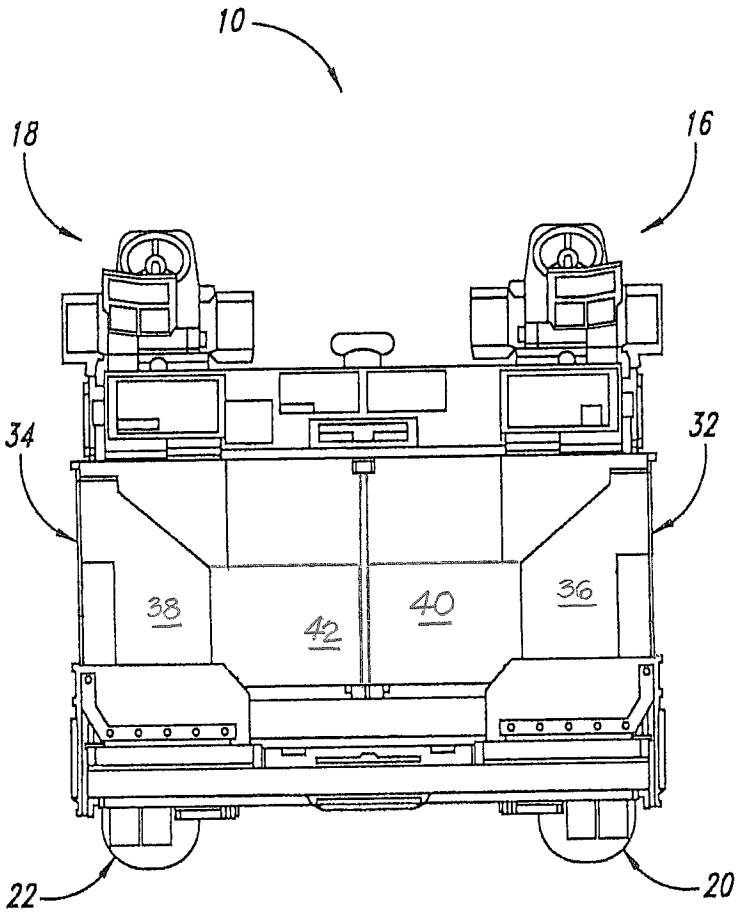
FIG. 3 is a front view of the paving machine shown in FIGS. 1 and 2, showing a pair of flow gates at the rear end of the asphalt receiving hopper.
Figure 4:
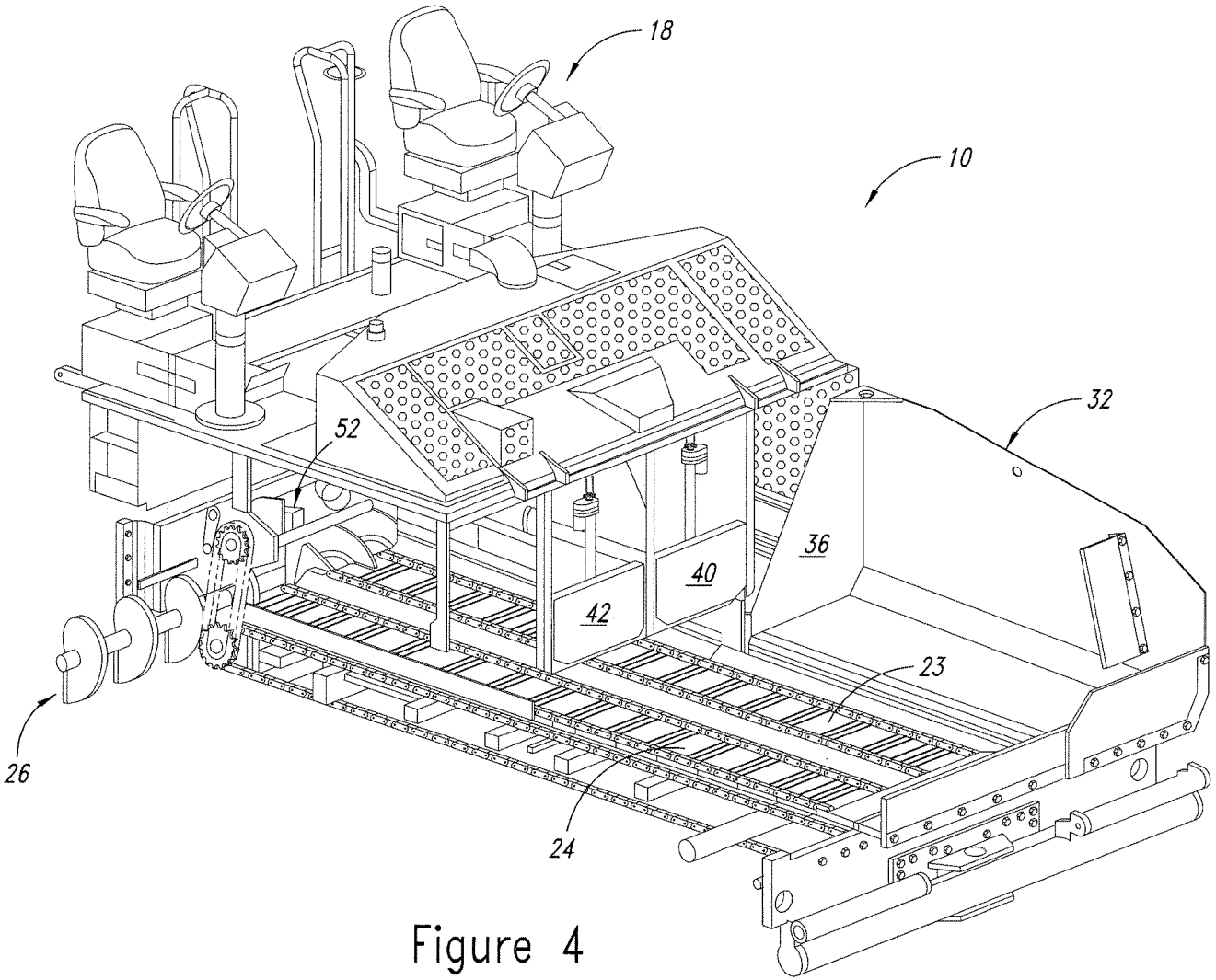
FIG. 4 is a front perspective view of a portion of the paving machine shown in FIGS. 1-3, illustrating the relationship between the hopper conveyors and the flow gates associated therewith.

Referring now to the drawings, FIGS. 1-4 illustrate paving machine 10, which includes asphalt receiving hopper 12 at its front end 14 for receiving asphalt material from a dump truck or material transfer vehicle. Paving machine 10 also includes left operator's station 16 and right operator's station 18. A pair of drive wheels 20 and 22 are driven by a conventional drive system so as to move the paving machine during the paving operation across the surface to be paved in the paving direction indicated by arrow P. Generally this conventional drive system includes an engine (not shown, but located generally behind asphalt receiving hopper 12 and beneath the left and right operators' stations) which powers a hydraulic drive system including a hydraulic pump and a plurality of hydraulic motors. The bottom of asphalt receiving hopper 12 is open, exposing left hopper conveyor 23 and right hopper conveyor 24 that are mounted below the hopper. Conveyors 23 and 24 transport asphalt paving material from asphalt receiving hopper 12 through a conveyor tunnel under the engine and the operators' stations to transverse distributing auger 26 that is located near rear end 28 of paving machine 10. Transverse distributing auger 26 is adapted to distribute the asphalt material received from the asphalt receiving hopper across the width of the roadway or lane to be paved. A floating screed (not shown) is attached to the paving machine by a pair of tow arms, one of which, tow arm 30, is illustrated in FIG. 1. The screed serves to compact the asphalt material and form an asphalt mat on the roadway.

Asphalt receiving hopper 12 is defined by left sidewall 32, right sidewall 34, left rear wall 36 and right rear wall 38. Vertically-adjustable left flow gate 40 is located adjacent left rear wall 36 at the entrance to the conveyor tunnel, and vertically-adjustable right flow gate 42 is located adjacent right rear wall 38 at the entrance to the conveyor tunnel. Left flow gate 40 is located over and is associated with left hopper conveyor 23, and is adapted to define the size of the gate opening from asphalt receiving hopper 12 to the distributing auger via left hopper conveyor 23. Similarly, right flow gate 42 is located over and is associated with right hopper conveyor 24, and is adapted to define the size of the gate opening from asphalt receiving hopper 12 to the distributing auger via right hopper conveyor 24. Mounted on the back side of left flow gate 40 is linear actuator 44, and mounted on the back side of right flow gate 42 is linear actuator 46. Linear actuators 44 and 46 are adapted to move the flow gates upwardly and downwardly along a substantially vertical line to increase or decrease the gate openings to the distributing auger.

Figure 5:
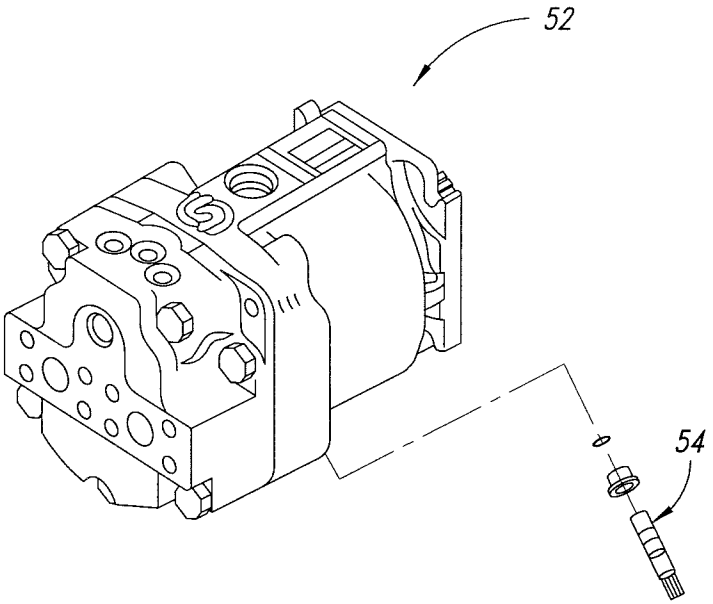
FIG. 5 is a perspective view of a hopper conveyor motor, showing the attachment of a speed sensor.
Figure 6:
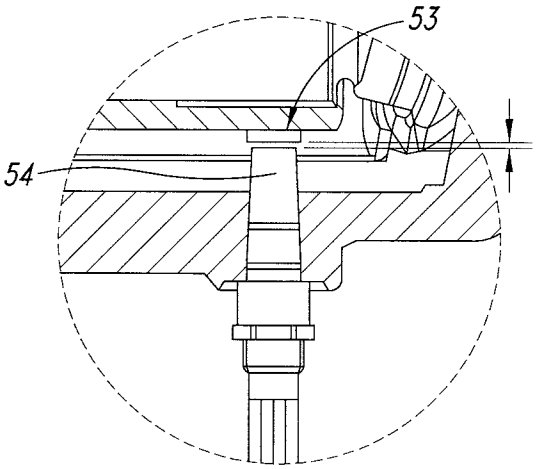
FIG. 6 is a sectional view of the portion of a hopper conveyor motor that includes an attached speed sensor.

Controller 48 is mounted in control panel 50 that is accessible to an operator from either left operator's station 16 or right operator's station 18. Controller 48 is operatively connected to linear actuators 44 and 46, and to right hopper conveyor motor 52 and a left hopper conveyor motor (not shown, but substantially identical to right hopper conveyor motor 52). Preferably, the hopper conveyor motors are hydraulic motors such as the Sauer Danfoss Series 40 hydraulic motor with magnetic speed ring that cooperates with a Sauer Danfoss KPP pulse pickup speed sensor to measure the speed of rotation of the motor. These Sauer Danfoss products may be obtained from the Sauer-Danfoss (US) Company of Ames, Iowa. As shown in FIGS. 5 and 6, hydraulic motor 52 includes magnetic speed ring 53, adjacent to which is mounted speed sensor 54. Controller 48 is operatively connected to speed sensor 54 which is associated with right hopper conveyor motor 52 (shown in FIGS. 5 and 6), and to a speed sensor (not shown, but substantially identical to speed sensor 54) which is associated with the left hopper conveyor motor. These speed sensors are adapted to transmit to the controller conveyor speed signals indicative of the speeds of the hopper conveyor motors (and thus of the hopper conveyors).

Similar motors (with speed sensors) may be provided to drive the conventional drive system including drive wheels 20 and 22, and these motors and associated speed sensors are also operatively attached to controller 48, so that the controller may be adapted to adjust the speed of the conventional drive system comprising the motors that drive wheels 20 and 22. Controller 48 is also adapted to receive a machine speed signal from the conventional drive system indicative of the speed at which paving machine 10 is moving across the surface to be paved.

Figure 7:
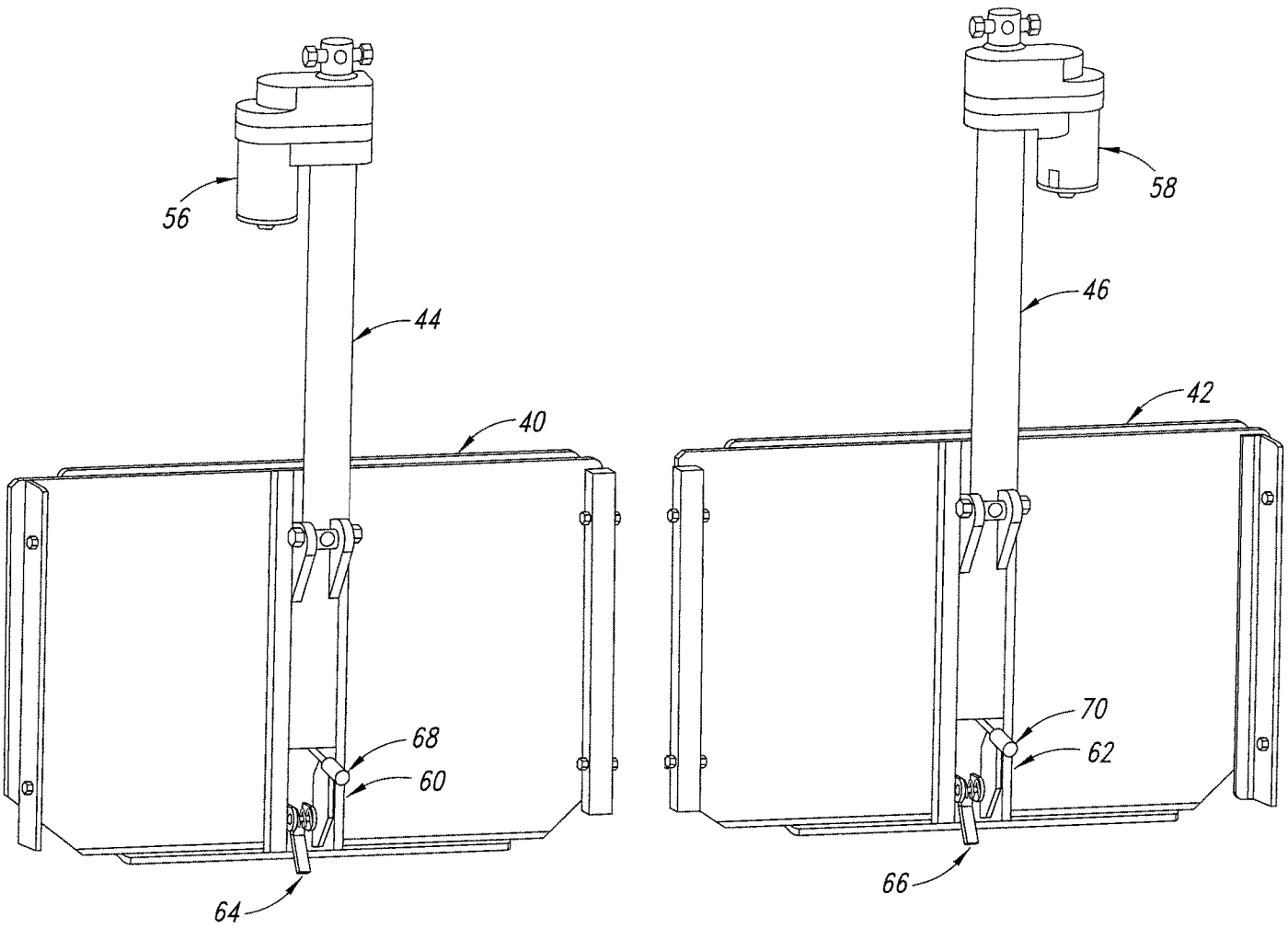
FIG. 7 is a rear perspective view of the flow gates that are part of the asphalt paving machine shown in FIGS. 1-4.

Controller 48 is also operatively connected to left flow gate position sensor 56, right flow gate position sensor 58, left material sensor 60 and right material sensor 62. The controller is adapted to receive flow gate signals indicating the vertical positions of the left and right flow gates. Controller 48 is also adapted to receive signals from left material sensor 60 and right material sensor indicative of the presence of material on the hopper conveyors associated therewith. Left material sensor 60 is located on the back side of left flow gate 40, as shown in FIG. 7, and right material sensor 62 is located on the back side of right flow gate 42.

Controller 48 includes a timer and is adapted to measure elapsed time. Controller 48 is also adapted to use the machine speed signal received from the conventional drive system, the conveyor speed signals received from the speed sensors associated with the hopper conveyor motors and the flow gate signals from the flow gate position sensors to measure the amount of asphalt paving material delivered to the distributing auger per unit of time. Preferably, the controller is adapted to measure the time during which asphalt paving material is delivered to the distributing auger, and to calculate the distance traveled by the paving machine while asphalt paving material is being delivered to the distributing auger.

As described above, controller 48 is adapted to measure the accumulated time during which asphalt paving material is delivered to the distributing auger. In some embodiments of the invention, controller 48 may be configured to receive a "start" input signal from an operator that is associated with the beginning of use of a wear item such as a conveyor chain or a screed plate. In these embodiments of the invention, the controller is adapted to measure the machine operating time and the tonnage of asphalt paving material delivered to the distributing auger during the period of use of a selected wear item.

Controller 48 may embody a single microprocessor or multiple microprocessors that include components for controlling operations of asphalt paving machine 10 based on input from an operator of the paving machine and on sensed or other known operational parameters. Controller 48 may include a memory, a secondary storage device, a processor and other components for running an application. Preferably, controller 48 is operatively connected to an onboard viewing screen which is adapted to display to an operator the amount of asphalt paving material delivered to the distributing auger per unit of time, as well as other information about the operation and use of paving machine 10 that is calculated or determined by the controller. The controller may also include a wireless transmitter (and an associated signal booster) which is adapted to transmit to an external receiver (such as a computer or cellular telephone) the amount of asphalt paving material delivered to the distributing auger per unit of time, as well as other information measured or determined by the controller. Various other circuits may be associated with controller 48 such as power supply circuitry, signal conditioning circuitry, solenoid driver circuitry and other types of circuitry. Numerous commercially available microprocessors can be configured to perform the functions of controller 48. It should be appreciated that controller 48 could readily be embodied in a general purpose computer or machine microprocessor capable of controlling numerous machine functions.

The speed sensors associated with right hopper conveyor motor 52 and the left hopper conveyor motor signal to controller 48 the rotational speed at which their associated hopper conveyor motors are operated to power the hopper conveyors to move asphalt paving material out of asphalt receiving hopper 12. Left flow gate position sensor 56 and right flow gate position sensor 58 signal to controller 48 the vertical positions of left flow gate 40 and right flow gate 42. These positions are used by controller 48 to determine the size of the gate openings into the hopper conveyor tunnel (and to the distributing auger) associated with the left hopper conveyor and the right hopper conveyor. Left material sensor 60 is pivotally mounted at the bottom of left flow gate 40 and is adapted to signal to controller 48 the presence of asphalt paving material on hopper conveyor 23 adjacent the flow gate. Similarly, right material sensor 62 is pivotally mounted at the bottom of right flow gate 42 and is adapted to signal to controller 48 the presence of asphalt paving material on hopper conveyor 24 adjacent the flow gate. Left material sensor 60 includes arm 64 that extends below the bottom of flow gate 40 on its rear side, as shown in FIG. 7. When asphalt paving material on hopper conveyor 23 is struck off by flow gate 40, arm 64 pivots upwardly, causing switch 68 to depress, thereby generating a "material present" signal that is transmitted to the controller. Similarly, right material sensor 62 includes arm 66 that extends below the bottom of flow gate 42 on its rear side. When asphalt paving material on hopper conveyor 24 is struck off by flow gate 42, arm 66 pivots upwardly, causing switch 70 to depress, thereby generating a "material present" signal that is transmitted to the controller. When these "material present" signals are obtained by controller 48, the controller can use the known information about the widths of the hopper conveyors and the sizes of the flow gates, as well as the signals obtained from the speed sensors associated with right hopper conveyor motor 52 and the left hopper conveyor motor, and the signals obtained from left flow gate position sensor 56 and right flow gate position sensor 58, to determine the rate of flow of asphalt material to the distributing auger. For example, if the flow gates and hopper conveyors are 41.425 inches wide, and the flow gates are set at a vertical location that is 4.0 inches above the conveyor floors, the area of the gate opening below each flow gate will be 165.7 square inches. If the drive sprockets on the hopper conveyors have a pitch diameter of 8.9 inches, and the hopper conveyor motors are operating at a sprocket rotation rate of 60 rpm, each hopper conveyor will advance at a rate of 1676.8 inches per minute. If the density of the asphalt paving material being used is 0.0634 pounds per cubic inch, the amount of asphalt paving material passing through the gate opening under each flow gate will be:

$$(165.7\ \text{in}^2)\times(1676.8\ \text{in/min})\times(0.0634\ \text{lbs/in}^3)\times(60\ \text{min/hour})\times(\text{ton}/2000\ \text{lbs})=528.5\ \text{tons/hr.}$$

If a coefficient of conveyor efficiency of 0.35 is assumed, the calculated rate of asphalt material passing to the distributing auger (through the gate openings under both flow gates) will be (2)×(0.35)×(528.5 tons/hr.)=370 tons/hr. The calculated rate of asphalt material passing to the distributing auger during a given period of time can be compared to the weight tickets from the asphalt plant showing the amount of asphalt paving materials loaded into the asphalt receiving hopper, and this information can be used to adjust the coefficient of conveyor efficiency, if necessary.

Although this description contains many specifics, these should not be construed as limiting the scope of the invention but as merely providing illustrations of some of the presently preferred embodiments thereof, as well as the best mode contemplated by the inventors of carrying out the invention. The invention, as described and claimed herein, is susceptible to various modifications and adaptations as would be appreciated by those having ordinary skill in the art to which the invention relates.

What is claimed is:

1. An asphalt paving machine comprising:

(a) a drive system that is operated to move the paving machine across a surface to be paved;

(b) an asphalt receiving hopper which is adapted to receive asphalt paving material;

(c) a distributing auger;

(d) a hopper conveyor that is adapted to transport the asphalt paving material from the asphalt receiving hopper to the distributing auger, said hopper conveyor comprising:

(i) a hopper conveyor motor;

(ii) a speed sensor that is associated with the hopper conveyor motor and adapted to measure the rate of rotation of the hopper conveyor motor;

(e) a vertically-adjustable flow gate that is associated with the hopper conveyor and adapted to define the size of the gate opening from the asphalt receiving hopper to the distributing auger, said flow gate further comprising a flow gate position sensor that is adapted to determine the vertical position of the flow gate;

(f) a controller including a timer, said controller being:

(i) operatively connected to the drive system for moving the paving machine across the surface to be paved and adapted to receive a machine speed signal indicating the speed at which the paving machine is moving across the surface to be paved;

(ii) operatively connected to the speed sensor that is associated with the hopper conveyor motor and adapted to receive a conveyor speed signal indicating the speed of the hopper conveyor;

(iii) operatively connected to the flow gate position sensor and adapted to receive a flow gate signal indicating the vertical position of the flow gate;

(iv) adapted to use the machine speed signal, the conveyor speed signal and the flow gate signal to measure the amount of asphalt paving material delivered to the distributing auger per unit of time;

(g) a material sensor that is attached to the vertically-adjustable flow gate, said material sensor:

(i) being operatively connected to the controller and adapted to signal to the controller if asphalt paving material is passing under the flow gate;

(ii) having an arm that extends below the bottom of the flow gate, said arm being adapted to pivot upwardly when asphalt paving material is struck off by the flow gate;

(iii) having a switch that is configured to be actuated when the arm of the material sensor pivots upwardly in order to signal the controller that asphalt paving material is passing under the flow gate.

2. The asphalt paving machine of claim 1 wherein the controller is operatively connected to an onboard viewing screen which is adapted to display to an operator the amount of asphalt paving material delivered to the distributing auger per unit of time.

3. The asphalt paving machine of claim 1 wherein the controller is operatively connected to a wireless transmitter which is adapted to transmit to an external receiver the amount of asphalt paving material delivered to the distributing auger per unit of time.

4. The asphalt paving machine of claim 1 wherein the controller is adapted to:

(a) measure the time during which asphalt paving material is delivered to the distributing auger;

(b) calculate the distance traveled by the paving machine while asphalt paving material is being delivered to the distributing auger.

5. The asphalt paving machine of claim 1 wherein:

(a) the vertically-adjustable flow gate includes a linear actuator for moving the flow gate substantially vertically to any of various positions between an upper position that maximizes the size of the gate opening from the asphalt receiving hopper and a lower position that minimizes the gate opening from the asphalt receiving hopper;

(b) the controller is operatively attached to the linear actuator and adapted to move the flow gate to a vertical position that is selected by an operator of the paving machine.

6. The asphalt paving machine of claim 1 wherein the controller is adapted to:

(a) measure the time during which asphalt paving material is delivered to the distributing auger;

(b) receive a "start" input signal from an operator that is associated with the beginning of use of a selected wear item of the asphalt paving machine;

(c) measure the tonnage of asphalt paving material delivered to the distributing auger during the period of use of the selected wear item.

7. The asphalt paving machine of claim 6 wherein the controller is adapted to measure the machine operating time during the period of use of the selected wear item.

8. An asphalt paving machine comprising:

(a) a drive system that is operated to move the paving machine across a surface to be paved;

(b) an asphalt receiving hopper which is adapted to receive asphalt paving material;

(c) a distributing auger;

(d) a hopper conveyor that is adapted to transport the asphalt paving material from the asphalt receiving hopper to the distributing auger, said hopper conveyor comprising:

(i) a hopper conveyor motor;

(ii) a speed sensor that is associated with the hopper conveyor motor and adapted to measure the rate of rotation of the hopper conveyor motor;

(e) a vertically-adjustable flow gate that is associated with the hopper conveyor and adapted to define the size of the gate opening from the asphalt receiving hopper to the distributing auger, said flow gate further comprising a flow gate position sensor that is adapted to determine the vertical position of the flow gate;

(f) a controller including a timer, said controller being:

(i) operatively connected to the drive system for moving the paving machine across the surface to be paved and adapted to receive a machine speed signal indicating the speed at which the paving machine is moving across the surface to be paved;

(ii) operatively connected to the speed sensor that is associated with the hopper conveyor motor and adapted to receive a conveyor speed signal indicating the speed of the hopper conveyor;

(iii) operatively connected to the flow gate position sensor and adapted to receive a flow gate signal indicating the vertical position of the flow gate;

(iv) adapted to use the machine speed signal, the conveyor speed signal and the flow gate signal to measure the amount of asphalt paving material delivered to the distributing auger per unit of time;

(v) adapted to receive a coefficient of efficiency for the hopper conveyor;

(vi) adapted to use the coefficient of efficiency in measuring the amount of asphalt paving material delivered to the distributing auger per unit of time.

9. An asphalt paving machine comprising:

(a) a drive system that is operated to move the paving machine across a surface to be paved;

(b) an asphalt receiving hopper which is adapted to receive asphalt paving material, said asphalt receiving hopper being defined by:

(i) a left sidewall;

(ii) a right sidewall;

(iii) a left rear wall; and (iv) a right rear wall;

(c) a distributing auger;

(d) a left hopper conveyor that is adapted to transport the asphalt paving material from the asphalt receiving hopper to the distributing auger, said left hopper conveyor comprising:

(i) a left hopper conveyor motor;

(ii) a speed sensor that is associated with the left hopper conveyor motor and adapted to measure the rate of rotation of the left hopper conveyor motor;

(iii) a vertically-adjustable left flow gate that is located adjacent the left rear wall of the asphalt receiving hopper and is adapted to define the size of the left gate opening from the asphalt receiving hopper to the distributing auger, said left flow gate further comprising a left flow gate position sensor that is adapted to determine the vertical position of the left flow gate;

(e) a right hopper conveyor that is adapted to transport the asphalt paving material from the asphalt receiving hopper to the distributing auger, said right hopper conveyor comprising:

(i) a right hopper conveyor motor;

(ii) a speed sensor that is associated with the right hopper conveyor motor and adapted to measure the rate of rotation of the right hopper conveyor motor;

(iii) a vertically-adjustable right flow gate that is located adjacent the right rear wall of the asphalt receiving hopper and is adapted to define the size of the right gate opening from the asphalt receiving hopper to the distributing auger, said right flow gate further comprising a right flow gate position sensor that is adapted to determine the vertical position of the right flow gate;

(f) a controller including a timer, said controller being:

(i) operatively connected to the drive system for moving the paving machine across the surface to be paved and adapted to receive a machine speed signal indicating the speed at which the paving machine is moving across the surface to be paved;

(ii) operatively connected to the speed sensor that is associated with the left hopper conveyor motor and adapted to receive a left conveyor speed signal indicating the speed of the left hopper conveyor;

(iii) operatively connected to the left flow gate position sensor and adapted to receive a left flow gate signal indicating the vertical position of the left flow gate;

(iv) operatively connected to the speed sensor that is associated with the right hopper conveyor motor and adapted to receive a right conveyor speed signal indicating the speed of the right hopper conveyor;

(v) operatively connected to the right flow gate position sensor and adapted to receive a right flow gate signal indicating the vertical position of the right flow gate;

(vi) adapted to use the machine speed signal, the left conveyor speed signal, the left flow gate signal, the right conveyor speed signal and the right flow gate signal to measure the amount of asphalt paving material delivered to the distributing auger per unit of time;

(vii) adapted to receive a coefficient of efficiency for the left hopper conveyor;

(viii) receive a coefficient of efficiency for the right hopper conveyor;

(ix) use the coefficient of efficiency for the left hopper conveyor and the coefficient of efficiency for the right hopper conveyor in measuring the amount of asphalt paving material delivered to the distributing auger per unit of time.

10. The asphalt paving machine of claim 9:

(a) which includes a left material sensor that is attached to the left flow gate, said left material sensor:

(i) being operatively connected to the controller;

(ii) having a left arm that extends below the bottom of the left flow gate, said left arm being adapted to pivot upwardly when asphalt paving material is struck off by the left flow gate;

(iii) having a left switch that is configured to be actuated when the left arm of the left material sensor pivots upwardly in order to signal the controller that asphalt paving material is passing under the left flow gate;

(b) which includes a right material sensor that is attached to the right flow gate, said right material sensor:

(i) being operatively connected to the controller;

(ii) having a right arm that extends below the bottom of the right flow gate, said right arm being adapted to pivot upwardly when asphalt paving material is struck off by the right flow gate;

(iii) having a right switch that is configured to be actuated when the right arm of the right material sensor pivots upwardly in order to signal the controller that asphalt paving material is passing under the right flow gate.

* * * * *